US006167655B1

(12) United States Patent
Santa Cruz et al.

(10) Patent No.: US 6,167,655 B1
(45) Date of Patent: Jan. 2, 2001

(54) STOP DEVICE FOR SLIDING CLOSURES

(76) Inventors: Cathy D. Santa Cruz, 7630 Tholl Dr., Reno, NV (US) 89506; Edward A. Carwin, 1306 Jones St., Reno, NV (US) 89503

( * ) Notice: Under 35 U.S.C. 154(b), the term of this patent shall be extended for 0 days.

(21) Appl. No.: 09/229,507

(22) Filed: Jan. 12, 1999

(51) Int. Cl.[7] ..... E05D 15/16
(52) U.S. Cl. ..... 49/407; 49/449
(58) Field of Search ..... 49/449, 407, 365; 70/89, 94, 95; 292/DIG. 46, 288, 289, 338, 339; 47/40; 211/134

(56) References Cited

U.S. PATENT DOCUMENTS

| | | | | |
|---|---|---|---|---|
| 342,476 | * | 5/1886 | Swartwout | 47/40 |
| 2,407,837 | * | 6/1946 | Kissel | 292/288 |
| 3,697,723 | * | 10/1972 | Winsler et al. | 219/218 |
| 4,068,761 | * | 1/1978 | McCarthy | 211/134 |
| 4,135,376 | | 1/1979 | Evans . | |
| 4,208,841 | | 6/1980 | Starks . | |
| 4,429,911 | | 2/1984 | O'Neal . | |
| 4,593,492 | | 6/1986 | Lumenello . | |
| 5,102,173 | * | 4/1992 | Schallern | 292/288 |
| 5,588,687 | * | 12/1996 | Pinkerton | 292/259 R |
| 5,611,550 | * | 3/1997 | Belser | 277/184 |
| 5,833,349 | * | 11/1998 | Apple | 362/84 |

* cited by examiner

*Primary Examiner*—Daniel P. Stodola
*Assistant Examiner*—Curtis A. Cohen

(57) ABSTRACT

A stop device comprising a rectangular elongated member having an attaching member adapted to attach the elongated member within a jamb liner of a window jamb. The elongated member having first and second interconnecting sections telescopingly connected to provide an adjustment in length of the elongated member. The elongated member having an elongated slot having a base and two sides. A support member extending perpendicularly from one side of the elongated member. The support member having a protrusion extending from one end of the thereof which slidably engages the base and two sides of the slot to fixedly attach the support member to the elongated member. The other end of the support member includes a threaded bore which receives a threaded member.

8 Claims, 4 Drawing Sheets

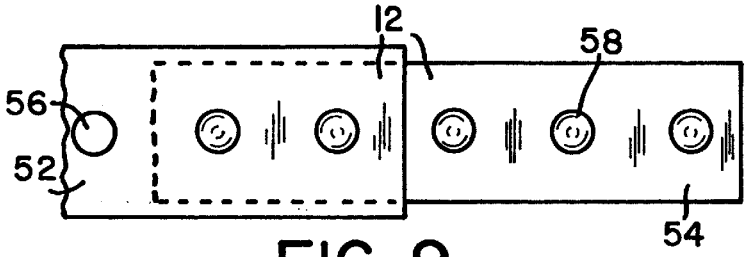
FIG. 9
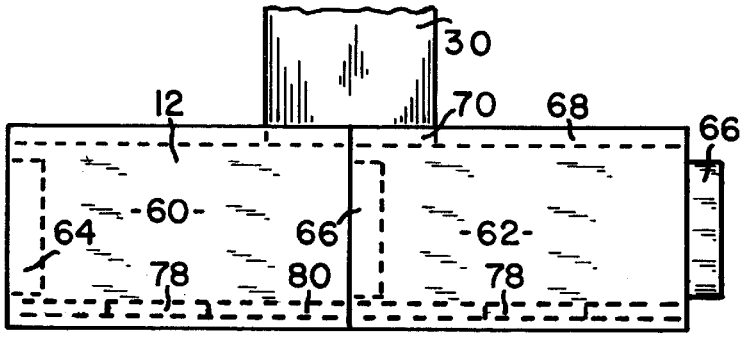
FIG. 10
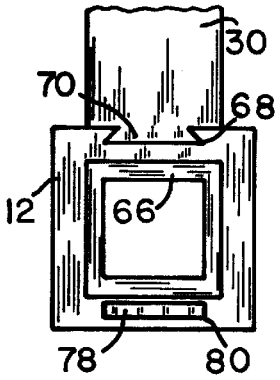
FIG. 11
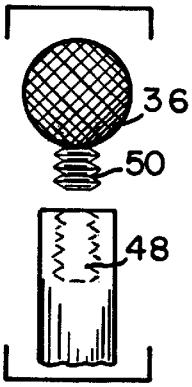
FIG. 12
FIG. 13
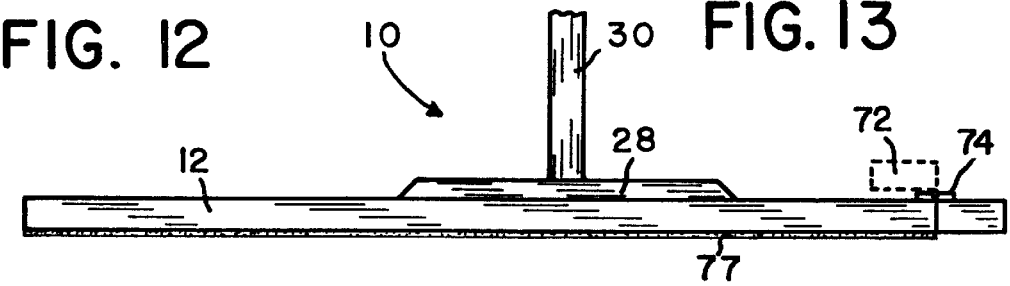

STOP DEVICE FOR SLIDING CLOSURES

FIELD OF THE INVENTION

This invention relates to stop devices used on sliding closures, such as windows, sliding glass doors, etc., and which prevents unauthorized opening thereof. However, the device more particularly relates to an adjustable decorative stop device that is not only aesthetically pleasing, but may also include various removable accessory items of user choice.

BACKGROUND OF THE INVENTION

It is well known in the field that sliding closures such as windows, glass doors, etc., are used to not only prevent unauthorized entry into an otherwise enclosed room, but are most often used to provide ventilation and vary room temperature as well. Therefore, many times the user will only slightly open the window or door so as to allow air to circulate, unfortunately this provides easy entry for burglars, or other criminals, thus this is can be very dangerous.

Therefore, within the prior art many attempts have been taught to overcome the above problem, however each have inherent drawbacks and disadvantages which the present invention not only recognizes, but addresses and resolves in a manner heretofore not taught.

For example, within U.S. Pat. No. 4,208,841 they provide a "stop assembly and system for slidinq closures" comprising an assembly in the shape of a wedge, with the wedge being attached to the window by at least one VELCRO strip. Whereby, when the closure is partially opened into a position of choice, the wedge becomes lodged substantially between the window and frame, thus preventing further opening of the window from the outside. This device is functional for its intended use, however this assembly is limited in use as the user must first determine where to attach the VELCRO strip, attach the wedge, and open the window until the wedge becomes lodged into place. Thus, the window can become damaged when the wedge is forced into position, and also if the user wishes to vary the distance the window can open, the VELCRO must be removed which can be difficult, or the user must attach multiple VELCRO strips, which is bothersome.

Yet another prior art reference is U.S. Pat. No. 4,135,376 which teaches a "patio door security bar with lock" wherein they provide an elongated bar which is installed within the window framework with multiple screws and sliding bolts, etc. This device is again functional for its intended use but is much too complicated, most unsightly when installed, and includes many parts, etc.

Further pertinent prior art references include U.S. Pat. Nos. 4,429,911, 4,059,141, and 4,593,492, each of which attempt to provide a means to lock or secure a closure member in a fixed position. However, each reference is extremely complicated, they are much too costly and difficult to install, and none include the unique and novel features of the present invention as will be seen within the following specification.

SUMMARY OF THE INVENTION

In accordance with the present invention we provide a stop device for sliding closures which inhibits opening of the sliding closure and is a deterrent for unauthorized entry there through.

It is accordingly a principle object of the present invention to provide a stop device comprising an elongated substantially rectangular shaped member which is of a shape and size to be easily inserted within or removed from either a sliding glass door frame or window frame, etc., respectively.

It is another object of the present invention to provide a stop device which may include means to be adjustably variable in length, so as to allow a user to partially open the closure if so desired.

Yet another object of the present invention is to provide a stop device which will not mar or damage the sliding closure in any way, as no installation tools are required, and no screws, bolts, etc., are used to secure the stop device into position.

A further object of the present invention is to provide a stop device which is of simple construction, and which can be made from substantially any desirable material of engineering choice, such as wood, plastic, or the like.

Still a further object of the present invention is to provide a stop device which is lightweight and easily carried by an adult or a child.

Also another very important object of the present invention to provide a stop device which is aesthetically pleasing.

A further object of the present invention is to provide a stop device which may include interchangeable decorative accessory attachments, such as a crystal ball, a comical figure, or even a holiday related attachment like a Christmas tree, etc.

Also another object of the present invention is to provide a stop device which may be manufactured in various sizes of engineering choice so as to be functional with different types of closures. Or if preferred, the stop device may be of a size and shape which is universal so as to be functional with substantially any size or various type of closure.

Yet another object of the present invention is to provide a stop device which may include a battery operated night light, etc.

Still another object of the present invention is to provide a stop device which may be manufactured from a fluorescent material, or each accessory item may be fluorescent, so as to glow in the dark.

Also another object of the present invention is to provide a stop device which is universal and can be installed within typical sliding glass doors, windows which are horizontally aligned, or windows which are vertically aligned, respectively.

Yet another object of the present invention is to provide a stop device which may include a magnet for increased stability and for removably securing the stop device when installed into the desired position.

Also another object of the present invention is to provide a stop device which may include an adhesive strip, VELCRO, or the like.

Still a further object of the present invention is to provide a stop device which requires minimal bending over to install, as the stop device includes an extending support member which easily functions as a handle.

Another object of the present invention is to provide a stop device which may also serve as a piggy-bank if so desired.

Yet another object of the present invention is to provide a stop device and a unique method of use.

Other objects and advantages will be seen when taken into consideration with the following specification.

BRIEF DESCRIPTION OF THE DRAWINGS

FIG. 9 is a partial plan view for varying the length of the present invention.

FIG. 10 is substantially another partial plan view for varying the length of the present invention.

FIG. 11 is substantially an end view of FIG. 10.

FIG. 12 is substantially a partial plan view for an accessory item for the present invention.

FIG. 13 is substantially another plan view for one embodiment of the present invention.

DETAILED DESCRIPTION OF THE DRAWINGS

Referring now in detail to the drawings wherein like characters refer to like elements throughout the various views.

Shown throughout the various views, (arrow 10) represents an overview of the present invention which is substantially a new and unique stop device for a sliding closure. It is to be understood that substantially any sliding closure having a fixed window and a slidable window is suitable for use with the present invention.

Figure 7:
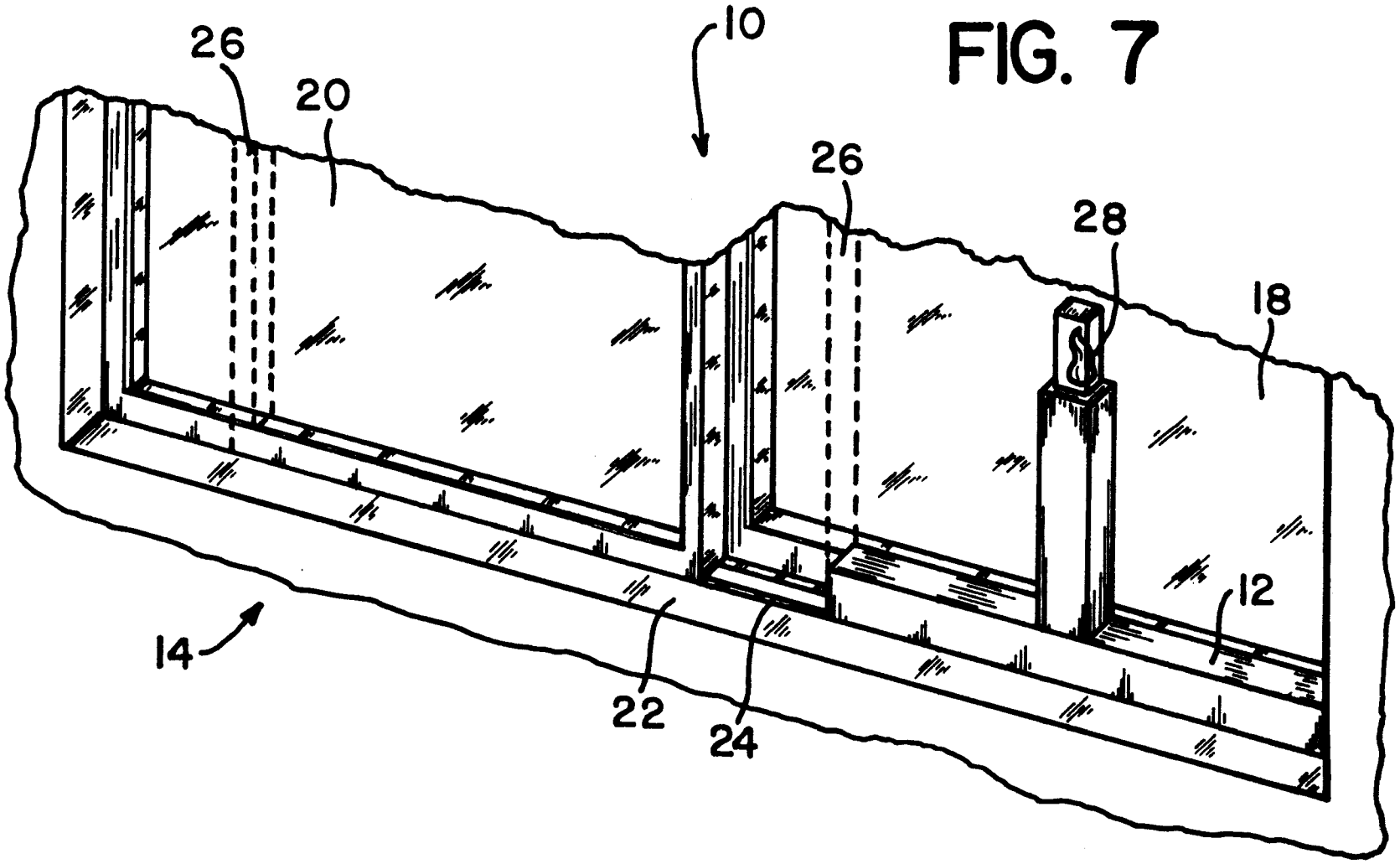
FIG. 7 is substantially a perspective plan view for the preferred embodiment of the present invention.
Figure 8:
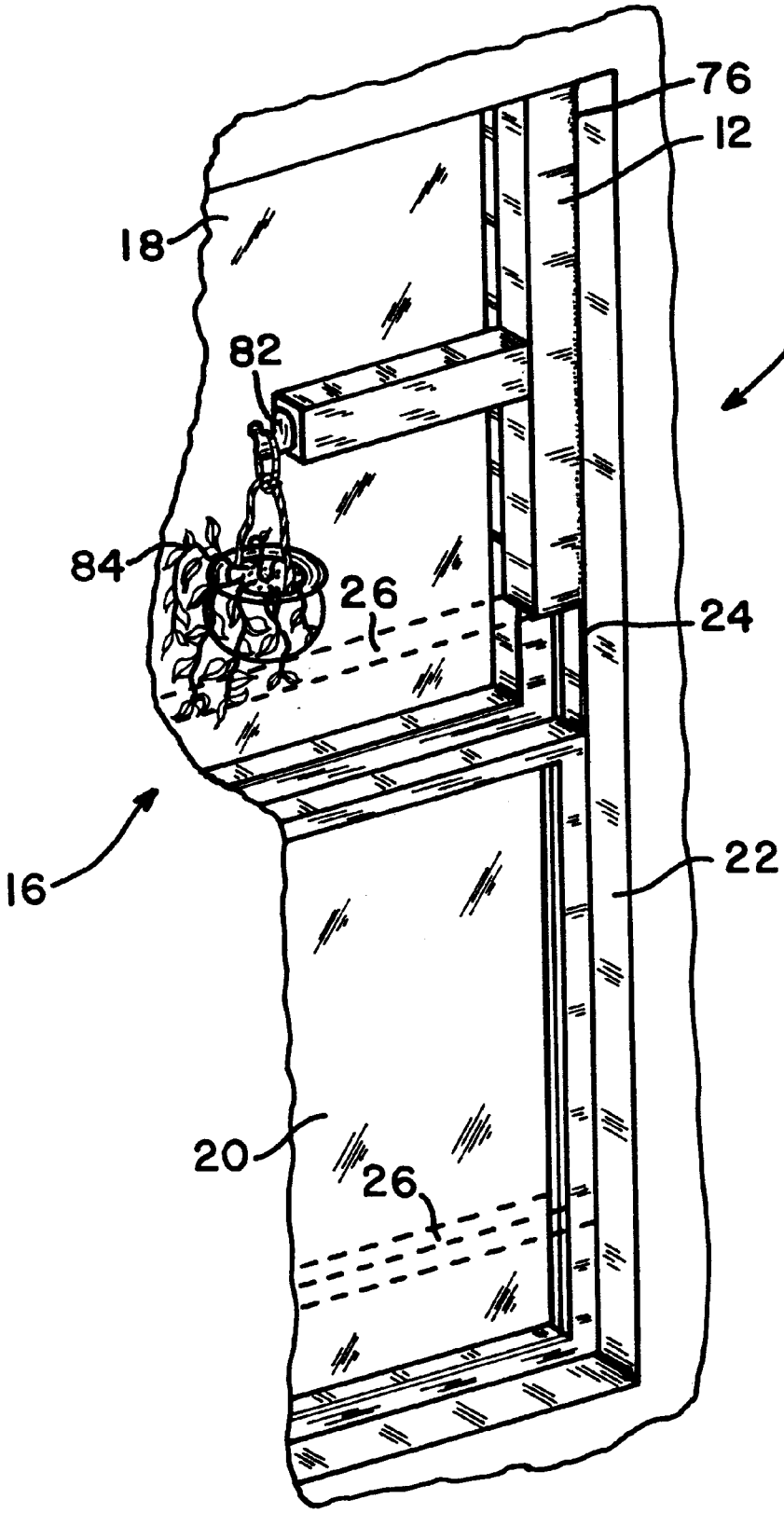
FIG. 8 is substantially a perspective plan view for a different embodiment of the present invention.

For example, the closure may be a typical pair of sliding glass doors (arrow 14), see FIG. 7, or the closure may be windows (arrow 16) which are substantially vertically aligned, see FIG. 8, or windows which are horizontally aligned, see FIG. 7. However, each closure includes a fixed window (18) and a slidable window (20), with each window (18 & 20) being contained within a common framework (22), and slidable window (20) being slidable upon a guide rail (24) between a fully closed position and a fully open position, with each window (18 & 20) being relative to each other and substantially spaced apart.

Stop device (arrow 10) substantially comprising an elongated member (12) having a first end, a second end, and a central section respectively. It is to be understood that member (12) is made from substantially any suitable material of engineering choice, such as wood, plastic, etc. Also, member (12) is of a shape and size to be removably positional upon guide rail (24) between one side of framework (22) and slidable window (20). Thus, when stop device (arrow 10) is in position, stop device and fixed window (18) are aligned parallel to one another respectively. Whereby, the length of stop device (arrow 10) determines how far slidable window (20) can be opened between the noted closed position and the open position. This is clearly seen in FIGS. 7 & 8 wherein we show substantially plan views for the present invention, with slidable window (20) being shown in its fully closed position, and a partially open position is represented by ghost lines (26). Therefore, one can easily see that the user may partially open slidable window (20) for ventilation purposes, or the like, without the risk of an intruder opening the window (20) from the outside. As stop device (arrow 10) limits the opening of window (20) and stop device (arrow 10) when in position is not accessible to the intruder.

It is to be understood that stop device (arrow 10) is of a width of engineering choice, such as depicted within FIGS. 7 & 8. However, if the stop device (arrow 10) is wider than guide rail (24) the device is still completely functional, as the device does not slide on guide rail (24) but is simply positioned substantially thereon. This allows stop device (arrow 10) to be substantially universal so as to fit within different closures having different widths.

Figure 1:
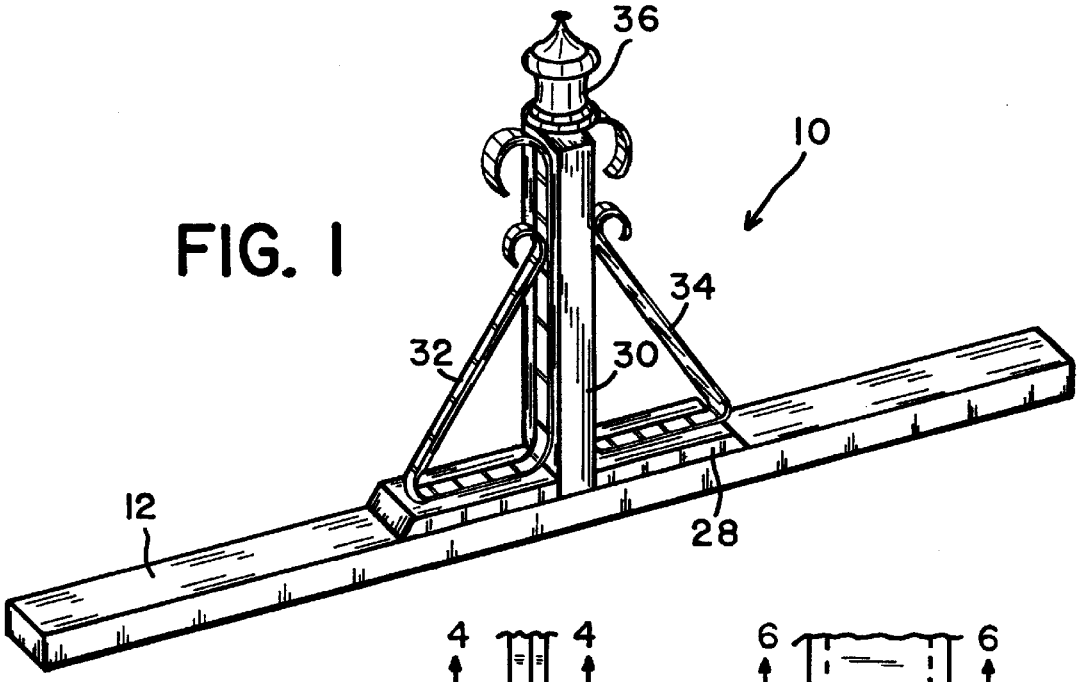
FIG. 1 is substantially a perspective overview of the present invention.
Figure 3:
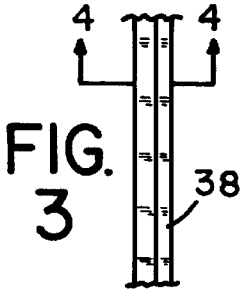
FIG. 3 is substantially a partial edge view of a mounting bracket.
Figure 5:
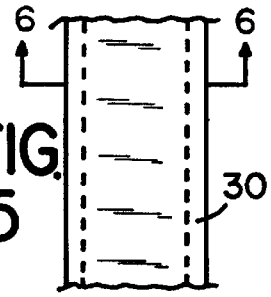
FIG. 5 is substantially a partial edge view of a support member for the present invention.

Referring now to FIG. 1, which represents the preferred embodiment for the present invention wherein stop device (arrow 10) further includes each of the following components: a elongated member (12); a base member (28); an extending support member (30); a left bracket (32); a right bracket (34); and an ornamental accessory item (36).

It is to be understood that each of the noted components may be made of any suitable material of engineering choice, such as wood, plastic, or the like and each of the components are of a shape and size of engineering choice. Also, it is important that extending support member (30) is of a sufficient height whereby a person when viewing the closure from either the outside or inside, can easily see the stop device (arrow 10) and the elevated ornamental accessory item (36). Furthermore, it is to be noted a very important feature is that extending support member (30) is functional as a handle so as to eliminate unnecessary bending over of the user.

It is to be further understood that elongated member (12) may be fixedly attached to either extending support member (30) or base member (28) by any suitable attachment means of engineering choice, such as by glue, or the like. Also, extending support member (30), and/or base member (28) may be fixedly attached to elongated member (12) at any suitable location of engineering choice, such as on either the first or second end, or as the applicants prefer, a central location is most aesthetically pleasing.

It is to be noted that stop device (arrow 10) is perfectly functional without either bracket (32 or 34) but the device is much more appealing if the brackets are included. Also, it is preferred by the applicants that no tools, screws, bolts, etc., are required by the user for installation of the present invention. Therefore, we herein provide unique attachment means which is illustrated in FIGS. 3–6 for attaching each of the brackets (32 & 34) to extending support member (30), but it is to be noted that any suitable attachment means of engineering choice may be used. The present attachment means includes brackets (32 & 34) each having an elongated protrusion (38) which is of a shape and size to be slidably inserted into a recess (40) located on extending support member (30). Thus, brackets (32 & 34) are fixedly yet slidably removably attached to extending support member (30). This is most advantageous as this allows the user to interchange different types of brackets (32 & 34) so as to achieve various aesthetic effects.

Figure 2:
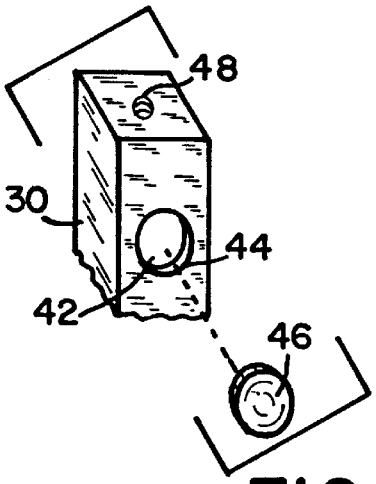
FIG. 2 is substantially a partial perspective view for one embodiment of the present invention.
Figure 4:
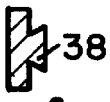
FIG. 4 is substantially a cut-a-way taken at 4—4 of FIG. 3.
Figure 6:
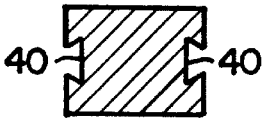
FIG. 6 is substantially a cut-a-way taken at 6—6 of FIG. 5.

In reference to FIG. 2, we provide an option for the user wherein extending support member (30) is substantially hollow having an interior compartment (42) which is in open communication with an aperture (44). With aperture (44) being of a shape and size to receive a coin there through and also frictionally retain a plug (46) therein. Whereby, stop device (arrow 10) functions as a piggy-bank, or storage unit for personal objects.

Extending support member (30) further includes attachment means for removably attaching ornamental accessory item (36) thereto, such as a threaded vertical recess (48) which is of a shape and size to threadably receive an elongated threaded member (50) which protrudes from ornamental accessory item (36), as clearly depicted in FIG. 12. However, it is to be understood any other suitable attachment means of engineering choice may be used.

Referring now to FIG. 9 which is illustrative of a different embodiment for the present invention. Wherein stop device (arrow 10) further includes means to manually vary the length. For example, elongated member (12) may be formed from at least first and second interconnecting sections (52 & 54) with the first section (52) being of a shape and size to slidably receive second section (54) therein. Section (52) having at least one aperture (56) there through, and section (54) having at least one protuberance (58) which is of a shape and size to be frictionally removably retained within aperture (56). Also, if preferred first interconnecting section (52) may be in the form of a sleeve, which is of a shape and size to slidably receive second section (54) therein, with the second section (54) being produced in different lengths. Whereby a user can easily adjust the length of elongated member (12) so as to be functional with different sized closures, or the user may adjust the length so as to limit the opening of the closure to a position of user choice. It is to be understood that if so desired protuberance (58) may also be in the form of a spring loaded button, or the like.

Referring now to FIGS. 10 & 11 which are illustrative of another embodiment for the present invention. Wherein stop device (arrow 10) further includes a different means to manually vary the length. For example, elongated member (12) may be formed from at least first and second interconnecting sections (60 & 62) with each section (60 & 62) having at least one aperture (64) and at least one protuberance (66). With aperture (64) being of a shape and size to slidably frictionally removably retain protuberance (66) therein. It will now be seen that multiple sections (60 & 62) may be interconnected until elongated member (12) is of the users desired length. Furthermore, each section (60 & 62) may include an elongated slot (68) substantially located on the top portion of each section (60 & 62), and extending support member (30) includes an elongated protrusion (70) which is of a shape and size to be slidably frictionally removably retained within elongated slot (68).

Thus is it will now be seen that the user can easily assemble the stop device (arrow 10) into the exact configuration of choice, as they can vary the length and they can slidably position support member (30) into the exact location of choice. This also allows the user to easily position accessory item (36) exactly where they wish so as to be easily visible when viewed through the closure.

Referring now to FIG. 13 which is illustrative of another embodiment for the present invention. Wherein stop device (arrow 10) further includes a different means to manually vary the length. For example, elongated member (12) may be formed from one piece with a portion (72) thereof being pivotably attached by a hinge (74). Whereby portion (72) is manually movable between a first elongated position shown by solid lines, and a second shortened position shown by ghost lines, respectively. Thus allowing the user to easily vary the length of elongated member (12).

As noted previously, stop device (arrow 10) of the present invention may be used with windows (18 & 20) which are either horizontally aligned or vertically aligned, as represented within FIGS. 7 & 8. However, if windows (18 & 20) are aligned vertically, then some attachment means must be used to secure stop device (arrow 10) in a removable yet affixed manner. For example, in FIG. 8 stop device (arrow 10) is removably affixed at a location of choice onto guide rail (24) by a loop and pile fastener, such as VELCRO (76), or an adhesive strip (77) or the like. Or if preferred, another attachment means may be used. For example, elongated member (12) may include an interior cavity (78) which is of a shape and size to slidably receive a magnet (80). Whereby stop device (arrow 10) is magnetically attached to guide rail (24) at a location of choice in a removable yet affixed manner.

As illustrated within FIG. 8, extending support member (30) may include an attachment device for supporting an object therefrom. For example, the attachment device may be in the form of a hook (82) which is of a shape and size to support and suspend the object therefrom, with the object being a potted plant (84), or the like.

It will now be seen we have herein provided a unique stop device having novel features, such as interchangeable accessory items (36) which can be of substantially any suitable aesthetically pleasing item. For example, a crystal ball is beautiful because when the crystal is in position, and sunlight shines through the closure, the crystal will reflect and disperse various colors in a pattern throughout the room, which is most pleasing to the user. Or if preferred, the accessory item (36) could be representative of a holiday related item, such as a Christmas tree, a pumpkin, an Easter bunny, etc. Or still further the accessory item (36) may be a battery or solar powered night light (86), or the like.

It will further be seen we have herein provide a stop device which may serve as a piqgy-bank if so desired, which is very unique.

We also include a method of use for the present invention including the following procedural steps:

a. attaching a first bracket (32) to support member (30) which extends from stop device (arrow 10);

b. attaching a second bracket (34) to support member (30);

c. grasping an accessory item (36);

d. attaching accessory item (36) to support member (30);

e. grasping attached accessory item (36) which serves as a handle for lifting stop device (arrow 10); and;

f. positioning stop device (arrow 10) at a location of user choice upon a guide rail (24) located within a sliding closure;

It is to be understood within the above method steps, "a" and "b" may be eliminated.

It will further be seen that we have herein provided a stop device (arrow 10) which may be made from substantially any suitable material of choice, and if so desired the device may be fluorescent so as to glow in the dark. Or perhaps the stop device may be made from ACRYLIC so as to be transparent for aesthetic purposes, etc.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and wish to secure by Letters Patent is:

1. A stop device comprising a rectangular elongated member having an attaching means for securely attaching said elongated member within a jamb liner of a window jamb, said elongated member having first and second interconnecting sections telescopingly connected to provide an adjustment in length of said elongated member, said elongated member having an elongated slot, said slot having a base and two sides;

a support member extending perpendicularly from one side of said elongated member, said support member having a protrusion extending from one end thereof which slidably engages the base and two sides of the slot to fixedly attach the support member to the elongated member, the other end of the support member includes a threaded bore which receives a threaded member.

2. The stop device of claim 1 is fluorescent so as to glow in the dark.

3. The stop device of claim 1 further includes a magnet for increased stability and for removably securing said stop device when installed into the desired position.

4. The stop device of claim 1 further includes a night light.

5. The stop device of claim 4 wherein said night light is battery operated.

6. The stop device of claim 1 wherein said stop device further includes an adhesive strip.

7. The stop device of claim 1 wherein the first and second interconnecting sections include a plurality of holes for providing a manual adjustment of the interconnecting sections.

8. The stop device of claim 1 wherein the support member includes an interior compartment, said compartment being in open communication with an aperture, said aperture being of a shape and size to receive a coin there through, and said aperture being of a shape and size to fractionally retain a plug therein.

* * * * *